US005217256A

United States Patent [19]

Lomas

[11] Patent Number: 5,217,256

[45] Date of Patent: Jun. 8, 1993

[54] PAPER STACK PROTECTION DEVICE

[76] Inventor: W. P. Lomas, 1319 Heights, Katy, Tex. 77493

[21] Appl. No.: 888,911

[22] Filed: May 26, 1992

[51] Int. Cl.[5] ..... B42D 1/00

[52] U.S. Cl. ..... 281/20; 281/28; 462/71

[58] Field of Search ..... 281/20, 27.3, 21.1, 281/28, 45; 462/71

[56] References Cited

U.S. PATENT DOCUMENTS

| | | | |
|---|---|---|---|
| 295,141 | 3/1884 | Akins . | |
| 536,315 | 3/1895 | Wright et al. | 281/20 |
| 768,313 | 8/1904 | Scherf | 281/20 |
| 964,895 | 7/1910 | Bernhardt | 281/20 |
| 1,146,591 | 7/1915 | Niedomanski | 281/28 |
| 1,468,685 | 5/1922 | Wise . | |
| 1,676,741 | 7/1928 | Moskowitz | 281/20 |
| 2,728,451 | 12/1955 | Leander | 281/20 X |
| 5,056,825 | 10/1991 | Templet . | |

*Primary Examiner*—Mark Rosenbaum
*Assistant Examiner*—Willmon Fridie, Jr
*Attorney, Agent, or Firm*—Bush, Moseley & Riddle

[57] ABSTRACT

A paper stack protection device is disclosed which has a triangular shaped pocket designed to accept a corner of a stack of papers. A staple through the pocket and the corner of a paper stack secures the pocket to the stack of papers. The top and bottom sides of the pocket provide a long fold back line along the hypotenuse of the front and back sides of the pocket so that the first and last sheets of the stack of papers are inhibited from tearing away from the stack.

4 Claims, 1 Drawing Sheet

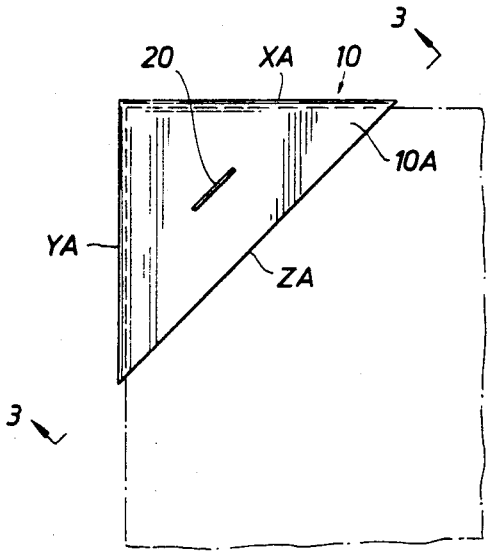
FIG. 1
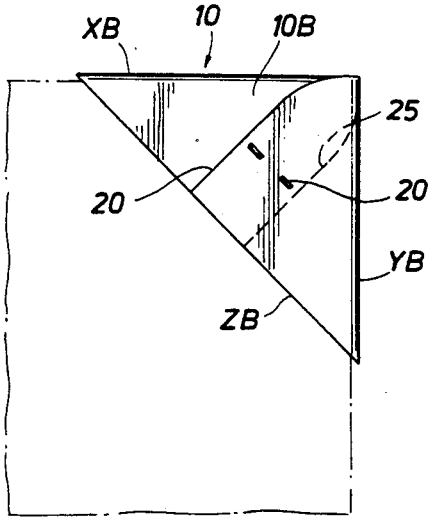
FIG. 2
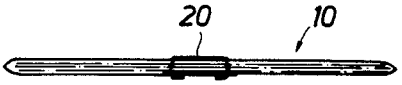
FIG. 3
FIG. 4
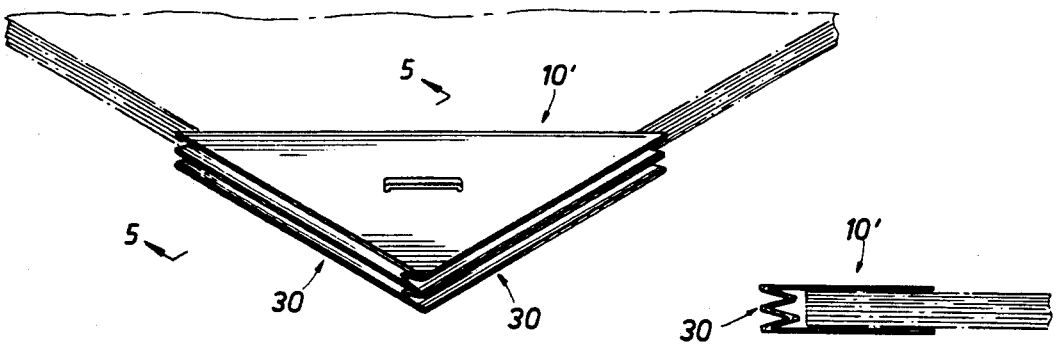
FIG. 5

PAPER STACK PROTECTION DEVICE

BACKGROUND OF THE INVENTION

1. Field of the Invention

This invention relates generally to stationery items, and in particular to a device for preventing the tearing away of first and last pages of a paper stack from a staple through the stack at its corner.

2. Description of the Prior Art

There has long existed a problem in the business world concerning stacks of paper fastened together by a staple through the corner of the stack. As a person works with the stack (e.g., a contract, memorandum, sales proposal, etc.), the first and last pages are routinely folded back at the corner and at the staple through the corner. Such first or last pages will often begin to tear at the staple, and many times will separate from the stack.

Before the invention as described, illustrated and claimed below, there has not been a simple solution to the problem described above. Of course, binding systems exist where an entire side of a paper stack is fastened, but the use of a staple in the corner of a paper stack remains a useful, inexpensive, rapid way to bind a paper stack.

There have been protectors for pages in a book (e.g., U.S. Pat. No. 295,141), but such protectors have not been adapted for use with a staple to bind a paper stack at its corner while inhibiting the first or last sheet of the stack from tearing away from the binding.

3. Identification of Objects of the Invention

In view of the identified need for a paper stack protection device as described above, a primary object of this invention is to provide such a device which is designed to inhibit the tearing away of the first and last sheets of a paper stack at the corner of the stack.

Another object is to provide an inexpensive, easy to use device for the enhancement of staple binding at the corner of a paper stack.

Still another object is to provide such a device which can expand to accept paper stacks of varying thicknesses.

SUMMARY

The objects identified above along with other advantages and features of the invention are embodied in a triangularly shaped pocket adapted to fit about the corner of a paper stack and accept a staple through such pocket and paper stack to bind same. The pocket has top and bottom sides of essentially triangular shape. The top and bottom sides each have a right triangular shape. Such top and bottom sides are in registration with each other such that their edges which form a right angle are joined with the hypotenuses of such top and bottom sides not being joined. The non-joined sides provide an opening into the pocket into which a corner of a paper stack may be inserted. The joined sides may include convolutions or folds which enable the pocket to expand to accept paper stacks of varying thicknesses.

After a paper stack is inserted into the pocket, the pocket and stack may be bound or secured by a staple, or rivet or the like. As the paper stack is in use, the first and last sheets of the stack are routinely folded back at the hypotenuse length of the top or bottom side of the pocket. Such fold back line is relatively greater than the staple or rivet, and as a result the first or last sheet is inhibited from tearing away from the stack. Advertising messages may be provided on the top or bottom sides of the protection device of the invention. The pockets may also be provided in different colors to signify stacks of paper of different kinds.

BRIEF DESCRIPTION OF THE DRAWING

The objects, advantages and features of the invention will become more apparent by reference to the drawings which are appended hereto and wherein like numerals indicate like parts and wherein an illustrative embodiment of the invention is shown, of which:

FIG. 1 is a top view of the paper stack protection device of the invention installed about a corner of a paper stack;

FIG. 2 is a bottom view of the protection device installed about a corner of a paper stack;

FIG. 3 is a view taken along lines 3—3 of FIG. 1;

FIG. 4 is a perspective view of the protection device of the invention showing folds or convolutions between sides of the device which allow it to expand to accept paper stacks of varying thicknesses; and FIG. 5 is a view taken along lines 5—5 of FIG. 4.

DESCRIPTION OF THE INVENTION

FIG. 1 is a top view, FIG. 2 a bottom view of a paper stack protection device 10 of the invention. The protection device 10 is installed about a corner of a stack 5 of sheets which are to be bound together by fastening its corner. Preferably such fastener is a staple 20, but it may be a rivet, brad or the like. Such protection device 10 is constructed to have essentially triangular top 10A and bottom 10B sides. Such sides are of right triangular shape with their edges XA, XB and YA, YB which form the right angle being joined, but their hypotenuse edges ZA, ZB not being joined. As a result an opening is created into which the corner of a paper stack may be inserted, as illustrated in FIG. 3. The staple 20 is inserted through the top 10A and bottom 10B sides and through the stack 5 of sheets which are to be bound at the corner of the stack.

In use, the sheet protection device 10 allows sheets to be folded back along hypotenuse ZA or ZB rather than at the fastener such as staple 20. As a result, a much longer fold line is created as compared to the fastener and as a result, the first and last sheets of the stack are inhibited from tearing away from the stack.

The sheet protection device 10 may be constructed in its simplest form by merely cutting off the corner of an envelop. Such cut-off corner creates a pocket which takes the form of the device 10 of FIGS. 1-3 of the drawings. The lines 22 and 25 illustrated on the back side of the device 10 in FIG. 2 represent edge lines of paper folded over and secured to form the back side of an envelop.

The protection device 10 of FIGS. 1-3 may be made of papers of different colors so that a user of the device may identify the stack of papers at a glance. Red could be used for a contract, Yellow for a draft, Green for a specification, and so on. Drawings and words may also be applied to front side 10A or back side 10B as advertising or for information concerning the stack itself, etc.

FIGS. 4 and 5 illustrate an alternative construction of the paper stack protection device of the invention. The right angle sides of the device are joined by convolutions 30 which allow the device 10' to expand to accept paper stacks of greater thickness than that shown in FIGS. 1-3.

While several embodiments of the present invention have been illustrated in detail, it is apparent that modifications and adaptations of the embodiments shown will occur to those skilled in the art. However, it is to be expressly understood that such modifications and adaptations are within the spirit and scope of the present invention as set forth in the following claims.

What is claimed is:

1. A paper stack protection device comprising a pocket of triangular shape, said pocket having top and bottom sides of substantially identical right triangle shape, said top and bottom sides being placed in registration with each other with their edges which form a right angle being joined and with their edges forming the hypotenuse not being joined, thereby creating an opening into said pocket, said pocket adapted to fit about a corner of a stack of papers and to accept a fastener through both sides of said pocket and said papers with the result that tope and bottom papers in the stack are inhibited from tearing away at said fastener, wherein said top and bottom sides have their edges which form a right angle joined by one or more convolutions, thereby allowing said top and bottom sides to expand so as to accept a thick paper stack.

2. A combination comprising a paper stack protection device including a triangularly shaped pocket having top and bottom sides of triangular shape, said top and bottom sides each having a right triangle shape, said top and bottom sides being in registration with each other such that their edges which form a right angle are joined, with the hypotenuse edges of said top and bottom sides not being joined, thereby creating an opening into said pocket via said hypotenuse sides of said pocket, a paper stack having one of its corners inserted into said pocket, and a staple through said top side of said pocket, said corner of said paper stack and through said bottom side of said pocket.

3. The combination of claim 2 wherein said top and bottom sides are identical in shape.

4. The combination of claim 2 wherein said top and bottom sides of said paper stack protection device have their edges which form a right angle joined by one or more folds, thereby allowing said top and bottom sides to expand so as to accept a thick paper stack.

* * * * *